US007320678B2

(12) United States Patent
Ruth et al.

(10) Patent No.: US 7,320,678 B2
(45) Date of Patent: Jan. 22, 2008

(54) FEEDING DEVICE FOR INFANTS

(76) Inventors: Anthony M. Ruth, 7213 Whispering Oak Dr., Sylvania, OH (US) 43560; Amy Ruth, 7213 Whispering Oak Dr., Sylvania, OH (US) 43560

( * ) Notice: Subject to any disclaimer, the term of this patent is extended or adjusted under 35 U.S.C. 154(b) by 43 days.

(21) Appl. No.: 11/268,927

(22) Filed: Nov. 8, 2005

(65) Prior Publication Data

US 2006/0129127 A1 Jun. 15, 2006

Related U.S. Application Data

(63) Continuation-in-part of application No. 10/403,931, filed on Mar. 31, 2003, now Pat. No. 6,966,904.

(51) Int. Cl.
*A61J 7/00* (2006.01)

(52) U.S. Cl. ..... 604/77

(58) Field of Classification Search ..... 606/234, 606/236, 235; 600/114, 115, 121, 127; 604/30–33, 604/77, 247–254
See application file for complete search history.

(56) References Cited

U.S. PATENT DOCUMENTS 3,790,016 A 2/1974 Kron
3,895,533 A 7/1975 Steier
4,232,687 A 11/1980 Anderson-Shanklin
4,813,933 A * 3/1989 Turner ..... 604/79
4,822,344 A * 4/1989 O'Boyle ..... 604/248
4,834,099 A 5/1989 Schrooten
4,966,580 A * 10/1990 Turner et al. ..... 604/67
5,040,756 A * 8/1991 Via Cava ..... 248/103
5,057,077 A * 10/1991 Turner et al. ..... 604/77
5,611,776 A 3/1997 Simmons et al.
5,830,235 A 11/1998 Standley
6,033,367 A 3/2000 Goldfield
6,120,528 A 9/2000 Link et al.
6,454,788 B1 9/2002 Ashton
6,966,904 B2 11/2005 Ruth et al.

* cited by examiner

*Primary Examiner*—Manuel Mendez
(74) *Attorney, Agent, or Firm*—David C. Purdue; John C. Purdue

(57) ABSTRACT

A feeding device especially for facilitating the transition from non-oral tube feeding to oral feeding is disclosed. The device comprises a fluid reservoir-having a fluid outlet, a nipple having a fluid outlet, a conduit for conveying fluid from the reservoir to the nipple fluid outlet and a manually adjustable valve that includes a manually settable selector to control the flow of fluid through the conduit and to vary it from zero flow to substantial flow. The device may include a shield associated with the nipple.

9 Claims, 10 Drawing Sheets

FEEDING DEVICE FOR INFANTS

REFERENCE TO RELATED APPLICATION

This is a continuation in part of application Ser. No. 10/403,931 now U.S. Pat. No. 6,966,904 issued on Nov. 22, 2005.

BACKGROUND OF THE INVENTION

1. Field of the Invention

The present invention is generally directed to a feeding device for infants and a method for weaning infants, especially premature neonates as well as post surgical infants and medically fragile infant patients, from non-oral tube feeding to oral feeding from a bottle.

2. Description of the Prior Art

In many neonatal intensive care units, premature neonates first receive nutrition through a nasogastric or orogastric feeding tube, because these infants are incapable of coordinating the suck, swallow and breathe cycle required to receive oral nutrition. The transition from tube feeding to oral nutritive feeding is often quite traumatic. Infants are presented with a bottle and often the rate of liquid flow is too rapid for the infant to initiate a timely swallow in coordination with breathing. Consequently, these infants become distressed because they are overwhelmed by too much fluid being introduced at too high a flow rate and may gag, choke or aspirate. These infants are returned to a non-oral tube feeding regimen until a physician decides that it is time to attempt bottle feeding again. In some cases, this cycle continues to the detriment of the infants who may well develop aversions to oral feeding.

U.S. Pat. No. 3,790,016 (Kron) discloses an infant nursing device comprising a liquid chamber, a nipple, an air inlet passage for the chamber, a liquid metering-passage between the chamber and an exterior portion of the nipple and may include a pressure transducer or a differential transducer. The device may include a valve for opening and closing the liquid metering passage in response to sensed conditions. The nipple may be solid except for the liquid metering passage or hollow so long as the flow of liquid out of the nipple is not responsive to compression of the nipple.

U.S. Pat. No. 6,033,367 (Goldfield) discloses a smart bottle and system for neonatal nursing development. According to the Goldfield patent, the system can be used to diagnose or monitor the sucking/swallowing/breathing competence of an impaired neonate or post-operative infant. The system includes a liquid feeding valve which controls the supply of nutrients through a feeding nipple via a processor. The processor operates to restrict or close the valve when slowing or cessation of breathing is detected or acts as a training device to set or pace, or initially to develop basic sucking/swallowing/breathing competence. The processor is also operable to control liquid flow to a level appropriate to the available sucking activity or to change the flow rate to maintain a stable and non-slowing breath rate. The processor is further operable to display an output that reflects the infant's breathing so that a care giver can manually operate a pressure bulb to rhythmically activate a pressure operated stimulator in the nipple.

SUMMARY OF THE INVENTION

The invention is based on the discovery of a feeding device and a method for facilitating the transition from non-oral tube feeding to oral feeding, particularly in premature neonates and medically fragile infants. The device comprises a fluid reservoir having a fluid outlet, a nipple having a fluid outlet, an optional shield attached to the nipple base to aid in forming a seal around an infant's mouth, a conduit for conveying fluid from the reservoir to the nipple fluid outlet and a valve associated with the conduit. The valve includes a selector that is settable to a first position in which the valve is operable to prevent the flow of fluid through the conduit and the selector is settable to other positions where the valve imposes different resistances to the flow of fluid through it. Preferably, the nipple is one that does not expel fluid when it is compressed but only expresses fluid when negative pressure is applied around the nipple outlet.

The method of the present invention comprises the steps of providing a device of the type just described, acclimating an infant to the device by closing the valve and inserting the nipple into the infant's mouth for a period of time to establish a functional and coordinated non-nutritive sucking pattern. The valve is then opened to permit the flow of fluid through the nipple outlet while restricting the flow of fluid so that, no matter how hard an infant sucks, the infant isn't able to withdraw fluid at a rate greater than a given rate, wherein the given rate is the rate that an infant with poor coordination of the sucking, swallowing and breathing cycle can handle without distress. The method comprises additional feeding regimens in which, if the infant didn't receive fluid at a rate that exceeded the infant's ability to swallow that fluid, restriction of the flow of fluid is gradually relaxed over a series of feedings until the infant is able to withdraw about sixty cubic centimeters of fluid during a twenty minute feeding without distress. If an infant suffers distress from receiving too much fluid at too fast a rate, the flow is quickly restricted until the infant is able to coordinate the suck/swallow/breathe cycle and feed without distress.

It is an object of the invention to provide an elegantly simple device that will facilitate the transition between non-oral tube feeding and oral feeding for physically challenged infants, especially premature neonates and medically fragile infants.

It is a further object of the invention to provide a method for weaning an infant from non-oral tube feeding to oral nutritive feeding.

It is yet another object of the invention to provide a device that is extremely easy to use and that can be used without causing distress to an infant, especially an infant whose sucking ability exceeds the infant's ability to swallow.

It is a still further object of the invention to provide a device and a method that gives an infant time to burst and pause without expressing fluid at a flow rate that exceeds the flow rate that the infant can handle.

It is yet a further object of the invention to provide a method that does not assault the fragile sensory system of a premature neonate by delivering too much fluid at too high a flow rate into the infant's mouth, which would increase the infant's risk of aspirating.

It is a further object of this invention to make it easy for multiple care givers, from skilled practitioners to parents with no previous experience with infant feeding, to participate in a consistent and efficacious method for weaning infants from non-oral tube feeding to oral nutritive feeding.

It is yet another object of this invention to foster the gradual development of coordinated sucking, swallowing and breathing cycles in infants as needed for successful oral nutritive feeding.

It is a still further object of this invention to provide a device for weaning infants from tube feeding that can be used successfully with infants who have the ability to suck in more fluid than they can swallow.

These and other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
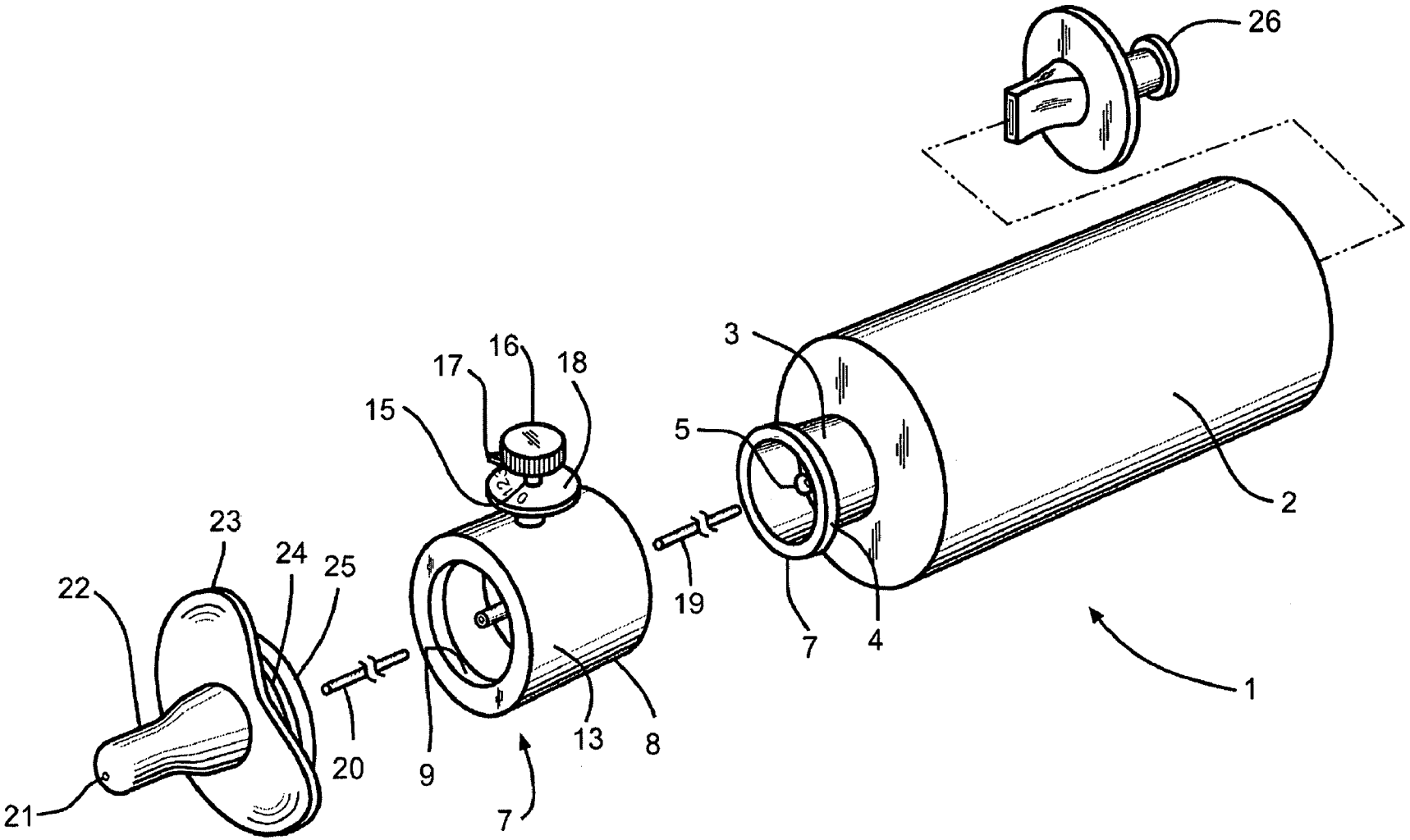
FIG. 1 is a perspective view of a feeding device according to the present invention.

The present invention is generally directed to a feeding device for infants and a method for weaning infants from non-oral tube feeding to oral feeding from a conventional bottle. More particularly, the feeding device and the method are used to gradually and safely promote the transition from non-oral feeding to oral nutritive feeding, i.e., a repetitive cycle of sucking, swallowing and breathing at a level or rate sufficient for an infant to intake at least about two ounces of nutritive fluid in a twenty minute session. The invention is particularly useful for premature infants that have not learned to coordinate the sucking, swallowing and breathing cycle sufficiently to enable them to take nutrition orally. The features of the invention will be more readily understood by referring to the attached drawing figures in combination with the following description.

When beginning to use the feeding device of the invention, a fluid flow control valve is set to prevent liquid from flowing through a nipple of the device so that an infant can establish a functional non-nutritive suck. Oral feedings are then begun with the valve of the device set to a minimum flow rate which is almost undetectable to an infant. The rate is gradually increased, preferably through adjustments to the valve mechanism. Alternatively, fluid flow rates can be controlled with a slide lock device, such as ones that are used to control the flow rate of fluids that are being administered intravenously, or through the use of different size tubing within the device. This flow rate progression allows an infant to gradually transition to faster flow rates without overwhelming the infant's delicate sensory system, thereby facilitating the gradual coordination of a functional suck/swallow/breathe pattern required for successful oral feeding from a bottle. If the infant is unable to achieve enough negative draw around the nipple to withdraw formula independently, the caregiver may assist by manually squeezing the bottle to express a small amount of liquid through the nipple. Alternatively, this can be achieved using an electric pump or a manual bulb type pump that can deliver a small amount of pressure with one measurable compression of the bulb connected to the end of the bottle which allows the caregiver to monitor exactly how fast and how much formula is being expressed. If desired, automated pump means may be provided to create a minimal positive pressure inside of a fluid reservoir of the device The act of nutritive sucking via bottle feeds is not typically initiated in premature infants until about 34 weeks after conception. Before that, nutrition is provided to these neonates through a variety of invasive methods including intravenous, oral gastric and nasogastric tube feedings. These infants often develop a functional non-nutritive suck in an attempt to calm and organize their systems. The introduction of nutritive feeding, however, can be extremely traumatic and over stimulating to the neonate when liquids are presented at rate that is too rapid so as be overwhelming to the infant's sensory system. When liquids are introduced in a manner that is too much, too fast or over stimulating, infants and neonates often cannot tolerate oral feeding and may develop an aversion to oral feeding. In addition, these unsafe feeding experiences may place the infant further at risk for medical complications such as aspiration, respiratory compromise and a general failure to thrive. In addition, the caregiver frequently becomes stressed by these negative feeding experiences which may lead to a discontinuation of oral feeding altogether. This can further inhibit and delay the healthy development of the neonate at a time when it is absolutely critical that the transition to oral feeding be initiated.

The more negative experiences an infant has in unsuccessful efforts at oral nutritive feeding, the greater the risk of feeding aversion becomes. In prior art methods, when a pacifier is removed, the established pattern of non-nutritive sucking is disrupted and this decreases the chances of establishing a functional nutritive sucking pattern on a nipple.

Many infants can develop a functional non-nutritive suck around a pacifier that has a given nipple structure and shape. However, infants can become extremely disorganized when the pacifier is removed and a bottle, with a nipple that is different in size, shape and or texture from the pacifier nipple, is introduced. The present device eliminates this disruption because it allows the infant to establish a functional non-nutritive suck around the nipple of the feeding apparatus, with zero fluid flow, and formula or breast milk is then introduced through the same nipple at an extremely low flow rate which is almost undetectable, to gradually prepare the sensory system as well as the respiratory system to coordinate a functional suck/swallow/breathe pattern. As the infant gains success at low rates of flow, the flow rate is gradually increased in almost undetectable increments so the infant does not become overwhelmed and stressed.

The nipple preferably has a straight configuration to facilitate central grooving of the tongue. This reduces the potential for tongue thrusting motion during fluid expression, which can result in a poor seal around the nipple, causing fluid to leak from the infant's mouth.

The capacity of the device to be set to zero flow or to different flow rates is the key to using the device to introduce nutritive feeding in a slow, graduated and easily controlled manner. The precise, repeatability that can be achieved by using the valve or other flow rate control device allows for consistency of flow rates between caregivers. This is very important because neonates in a Neonatal Intensive Care Unit (NICU) or Pediatric ICU will have many different caregivers. This device will prove to be not only beneficial to the neonate's healthy transition to standard or conventional nipple flow rates, but also very helpful to the caregiver in the incredibly demanding atmosphere of a NICU or Pediatric ICU as well as an unskilled caregiver or parent when an infant is discharged to home. It also allows for a systematic, slow progression of flow rate with successful feedings. As the infant becomes successful with nutritive sucking at a slow flow rate over several feedings, the rate can be gradually increased so that the increase is nearly undetectable to the infant. This gradually trains the infant's oral motor, sensory and respiratory systems to adjust to a higher rate of flow in a highly controlled and consistent manner in preparation for nutritive feedings at a regular flow rate from a standard nipple. So much so that it can over time be medically prescribed based on historical results with similar patients and somewhat exacting "programs" can be adopted to greatly increase the success of transition to oral feeding for infants and neonates. For example, if a feeding regimen with a flow rate of "1" (or lowest possible rate other than a zero flow rate) for about 20 minutes is prescribed for a few feedings, it can be administered consistently between caregivers and precisely increased to a "2" (or slightly higher flow rate) when the infant or neonate has mastered the flow rate of "1". While normal healthy babies rarely would need this type of feeding regimen, the incredibly delicate state of a premature baby, post surgical infant or medically fragile infant may require it.

Another key component of the invention is the use of a large reservoir which allows an infant to ingest up to two fluid ounces without interruption to refill the feeding apparatus. This is particularly important because an interruption affects not just the suck/swallow/breathe pattern but also the "burst and pause" portion of the infant feeding process. This is critical and it is highly documented that the pause portion allows the infant to calm and organize. It is critical that this cycle not be interrupted because it can be very detrimental to the infant's immediate and possibly long term ability to successfully thrive at the oral feeding process. In other words, if the nipple is removed from an infant's mouth to refill a reservoir, it is very detrimental to the process of developing the suck, swallow, breathe, burst and pause process required for successful oral nutritive feeding. While the process seems ridiculously easy to an average adult or child, it is a most daunting and difficult process, especially for premature and medically fragile infants.

In one embodiment of the invention, fluid can be manually or automatically expressed by a caregiver from the reservoir to the nipple fluid outlet, in case the infant is unable to achieve enough negative pressure around the nipple to express formula independently. The optional pump features previously described enable the caregiver to consistently measure the rate at which fluid is being expressed to further help maintain consistency between caregivers.

Figure 2:
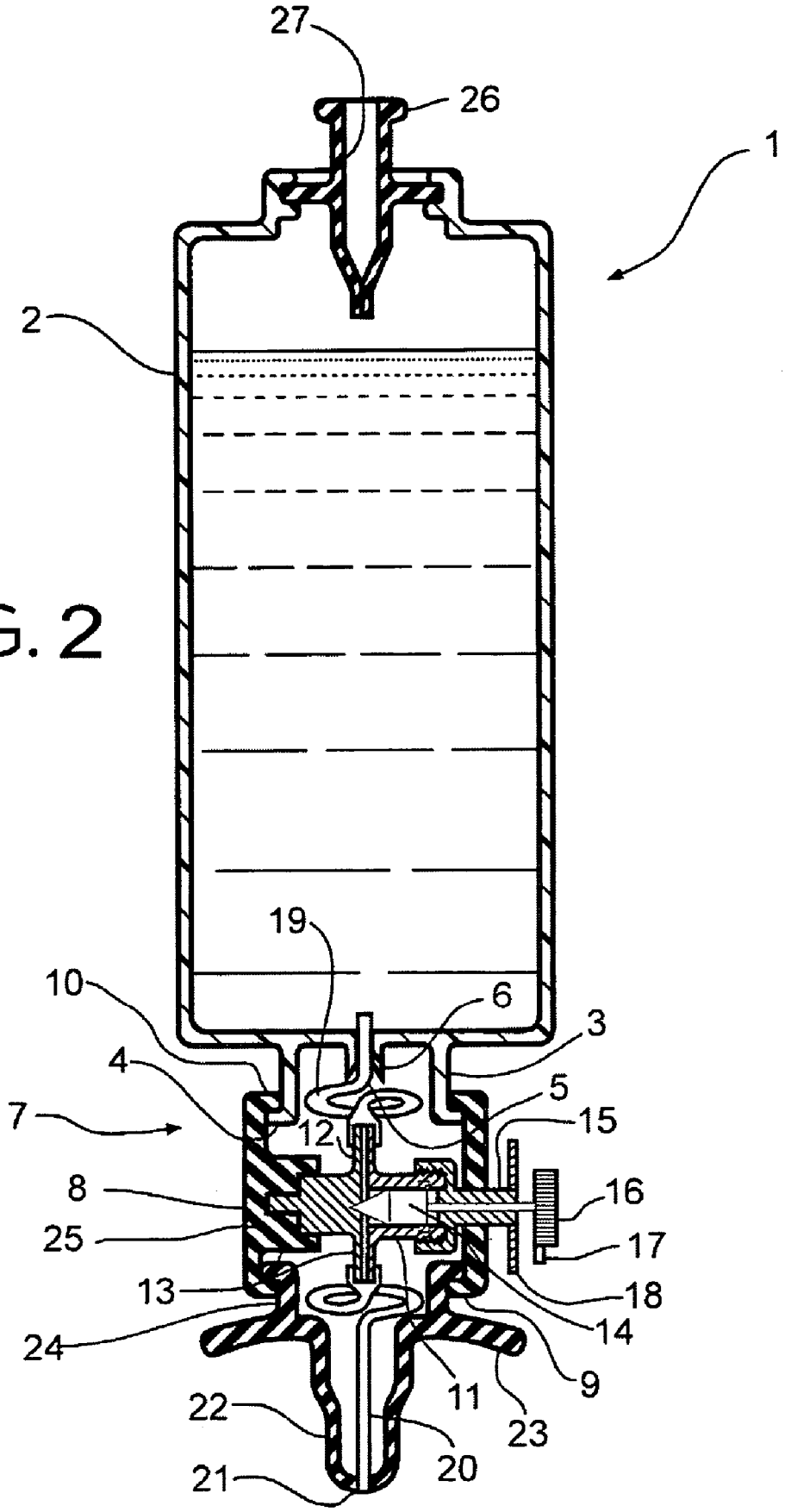
FIG. 2 is a view, mostly in cross-section, of the feeding device shown in FIG. 1.

Turning now to FIG. 1, a feeding device according to the invention is indicated generally at 1 and includes a reservoir 2 that can be a bottle type of container that is frequently used to feed infants. The reservoir 2 has a cylindrically shaped neck 3 extending from one end with a flange 4 extending outwardly from the neck 3. Inside the neck 3 is a fluid outlet indicated at 5 for the reservoir 2 and the outlet 5 is defined by an axially extending flange 6 (FIG. 2). Referring, again, to FIG. 1, the reservoir 2 can be made of a compressible material such as plastic so that the reservoir 2 can be compressed to create a positive pressure in the reservoir 2. Alternatively, the reservoir 2 can be formed of a rigid material. Fluid may also be contained within a plastic bag (not shown) carried within the reservoir 2, if desired.

A valve device indicated generally at 7 has a housing 8 that is generally cylindrical in shape with an inwardly extending flange 9 at one end and an inwardly extending flange 10 (FIG. 2) at the other end. The flange 10 of the valve housing 8 is operable to engage the flange 4 of the neck 3 of the reservoir 2 to releasably connect the valve device 7 to the reservoir 2. The valve device 7 includes a valve body 11 having a fluid inlet 12 and a fluid outlet 13. A needle valve element 14 is axially movable within the valve body 11 and is operably connected to a selector in the form of a valve stem 15 that is supported in the valve body 11 so that rotation of the valve stem selector 15 moves the needle 14 from a first position in which it closes communication between the fluid inlet 12 and the fluid outlet 13 and a second position in which there is communication between the inlet 12 and the outlet 13. In between the first and second positions, the needle 14 will restrict, more or less, the flow of fluid through the valve body 11. A knob 16 is supported on the valve stem 15 and includes a pointer 17. A valve face 18 with indicia representing various rotational positions of the valve stem 15 and corresponding axial positions of the needle 14, is supported below the knob 16 so that it cooperates with the pointer 17 to provide a caregiver with an indication of whether the valve is open or closed and, if it is open, a quantitative or qualitative indication of the rate at which fluid will flow through the valve body 11 to the outlet 13. The valve body 11 may house a needle type valve, as shown, or another suitable flow rate controlling valve or other suitable device that can control the rate of flow of a fluid.

The fluid outlet 5 of the reservoir 2 is connected to the fluid inlet 12 of the valve body 11 by a small diameter tube 19. One end of the tube 19 has a frictional fit around the outside of the valve inlet 12 and the other end of the tube 19 has a friction fit within the axially extending flange 6 on the reservoir. The small diameter tube 19 has an internal diameter from about 3 french to about 12 french, with a range from 5 french to about 8 french being preferred. It will certainly be appreciated that there are other ways to connect a valve or flow control device to the outlet of a reservoir. For example, the valve housing 8 can be formed integrally with the reservoir 2. The modular design of the device 1 is preferred, but other designs can be used to control the flow of fluid from the reservoir 2 to the valve inlet 12.

A small diameter tube 20 is connected to the fluid outlet 13 of the valve body 11 and carries fluid to a fluid outlet 21 in a nipple 22. A shield 23 is provided with the nipple 22 and the shield 23 is adapted to provide a seal around the lips of an infant so that when an infant has the nipple 22 in its mouth and its lips against the shield 23, the infant can suck and create a negative pressure operable to withdraw liquid into its mouth from the nipple outlet 21, through the tube 20 when the valve device 7 isn't closed. As shown in FIG. 2, a cylindrical flange 24 extends from the shield 23 and is provided with an outwardly extending flange 25. That flange 25 is operable to engage the flange 9 on the valve housing 8 to connect the nipple 22 and the shield 23 to the valve housing 8, in the same manner that the valve housing 8 is connected to the reservoir 2.

In some applications, it may be desirable to provide a plurality of feeding devices, similar to the feeding device 1, but without a valve device 7. Such a plurality of feeding devices would constitute a set and each include a reservoir for liquid and each would be provided with a different sized tube for conducting fluid from the reservoir to a nipple outlet. In such a set of feeding devices, the internal diameter of the connecting tube would effectively control the rate at which an infant can withdraw liquid from the device. Zero flow could be accomplished in one of the devices in a number of ways including not filling the reservoir and not including a tube at all. Alternatively, a single reservoir could be used with a plurality or set of nipples, each provided with a differently sized connecting tube. In either case, when it is desired to increase or decrease the flow rate of liquid to be supplied to an infant, the size of the connecting tube that is used in the feeding device can be changed. The flow rate for each size of connecting tube can be readily determined so that the appropriate tube is used for the particular feeding stage of the infant. In particular, once the infant is learning to feed, the size of the tube can be changed to adjust the rate at which liquid is supplied to the infant. Using a tube to control the flow rate in a set of feeding devices might reduce the cost of the feeding device and would make the part of the feeding device that comes into contact with the infant more practically a disposable product.

In a feeding device according to the invention, it is preferred to use a straight type of nipple such as the nipple 22. This most closely simulates a mother's nipple and facilitates an action known as central grooving of the tongue where an infant's tongue curves around the outside barrel of a straight nipple. As noted previously, the nipple 22 is preferably designed so that compression of the nipple doesn't cause fluid to be expelled from it. In the case of nipple 22, fluid is delivered to the outlet 21 through the tube 20 so that the nipple 22 doesn't fill up with liquid. If the nipple 22 did fill up with liquid, compression applied to the nipple would expel liquid within the nipple to be expressed. Accordingly, the tube 20 connecting the valve outlet 13 to the nipple outlet 21 makes the nipple 22 one that is configured so that compression of the nipple doesn't cause any significant quantity of fluid to be expelled from the nipple fluid outlet 21. This result can also be accomplished with a nipple (not shown) that is solid except for a small diameter liquid passageway connected to the nipple fluid outlet. In some cases, infants may be unable to tolerate even the very low flow rate of liquid through a straight nipple with a fluid outlet positioned at the end like the fluid outlet 21. In such cases, a nipple of the type disclosed in U.S. Pat. No. 6,454,788, the disclosure of which is incorporated herein by reference, may be employed. That nipple has a linear array of nipple fluid outlets arranged so as to direct fluid expelled from the nipple into physiologic gutters adjacent to the tongue, thereby possible avoiding stimulation of the gag reflex.

The reservoir 2 is provided with an air inlet valve 26, which is positioned in a fill passageway 27 provided on one end of the reservoir 2, opposite the end where the neck 3 is located. The air inlet valve 26 allows air to be drawn into the reservoir 2 so that a negative pressure doesn't develop inside the reservoir 2 when fluid is withdrawn therefrom. A negative pressure inside of the reservoir 2 can interfere with the delivery of fluid to the nipple outlet 21. A duckbill type of air valve 26 is especially well suited for use in the device 1. However, it will be clearly understood that other air valves, especially one way valves, can be utilized. When the air valve 26 is removed, the fill passageway 27 is open and can be used to fill the reservoir 2 with formula, breast milk or other beneficial fluids for an infant.

In order to use the device 1, a liquid is put into the reservoir 2 and the valve 26 is inserted to close the reservoir 2. The ends of the tube 19 are connected, as needed, to the valve inlet 12 and the reservoir fluid outlet 5. The ends of the tube 20 are connected, as needed, to the valve outlet 13 and the nipple 22 and, specifically, the nipple fluid outlet 21. It will be appreciated that one or more ends of the tube 19 or the tube 20 might be pre-connected to or even integral with the associated structure of the device 1. In the first step of employing the device 1 in a method to transition an infant from non-oral tube feeding to oral nutritive feeding, the nipple 22 is inserted into the infant's mouth while preventing the flow of nutritional fluid from the reservoir 2 through the nipple outlet 21, by closing the valve device 7 to prevent the flow of liquid through the valve body 11. This will acclimate the infant to the nipple 22 and the presence of the nipple 22 in the infant's mouth will encourage the infant to engage in sucking. However, no fluid will enter the infant's mouth. After a suitable acclimation period, for example, 5 to 10 minutes, the valve knob 16 is adjusted, thereby permitting the flow of fluid through the valve 7 to the nipple outlet 21. The valve 7 restricts the flow of fluid so that, no matter how hard the infant sucks, the infant is not able to withdraw fluid at a rate greater than a given rate from the nipple outlet. The given rate is the rate that an infant with poor coordination of the sucking, swallowing and breathing cycle of feeding could handle without distress. For purposes of illustration, the given flow rate might be one that would enable the flow of about 10 cubic centimeters of liquid over a twenty minute period out of the nipple outlet 21, under negative pressure that an infant with good sucking ability could establish. A higher or lower flow rate may be employed at this stage in the method, however. It should be noted that infants salivate and those infants who can swallow their saliva without distress have established at least a minimal degree of coordination of the suck/swallow/breathe pattern required for oral nutritive feeding. The given flow rate can advantageously be a rate that corresponds with the rate of saliva production because this will most likely not be overwhelming to the infant. If it is, the flow can be immediately reduced.

The method comprises additional subsequent feeding regimens wherein, if, during the first feeding regimen, the infant did not receive fluid at a rate which exceeded the infant's ability to swallow that fluid, restriction of the flow of fluid is sequentially gradually relaxed somewhat until the infant is able withdraw at least about sixty cubic centimeters of fluid during a twenty minute feeding without distress. The exact flow rates of sequential feeding regimens is not critical to the method of this invention. What is critical is that when fluid is first introduced through the nipple outlet, it is done at a rate that will not put an infant, even one with poorly coordinated suck/wallow/breathe patters, into distress. It is also critical that the flow rate be slowly and sequentially increased over several feedings at a rate corresponding with, or slower than, the rate at which the infant develops coordination of the suck/swallow/breather pattern needed to move from non-oral tube feeding to oral feeding. It is also critical that if, during the first feeding regimen or subsequent feeding regimens, the infant suffers distress from receiving fluid at a rate which exceeded the infant's ability to swallow, the flow of fluids is promptly restricted to a lower rate until the infant is able to feed without distress at that rate. Thereafter, the flow rate can be sequentially and gradually increased until the infant can take about 60 cubic centimeters of liquid in a twenty minute feeding. Up to that point, non-oral tube feeding will likely be continued. Once that rate is achieved however, non-oral tube feeding can be withdrawn in favor of oral feeding.

Figure 3:
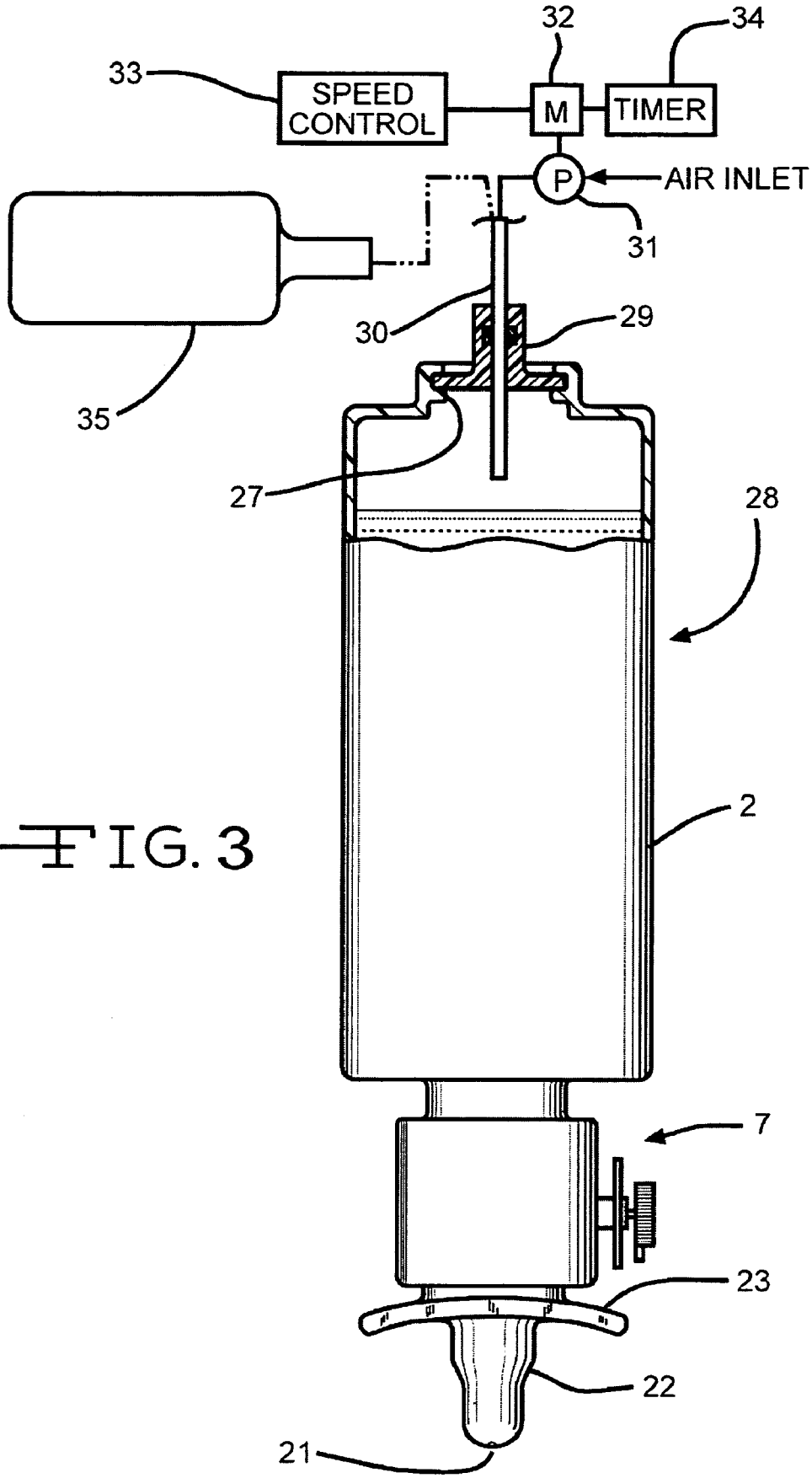
FIG. 3 is a view, partially in cross-section, of the feeding device shown in FIGS. 1 and 2 incorporating additional features.

Referring now to FIG. 3, a feeding device indicated generally at 28 corresponds generally with the feeding device 1 illustrated in FIGS. 1 and 2, except that the air inlet valve 26 has been replaced with a tube support 29 for supporting a tube 30 in the fill passageway 27. One end of the tube 30 extends into the reservoir 2 and the other end of the tube 30 is connected to a pump 31 that can be operated to pump air through the tube 30 to pressurize the inside of the reservoir 2. When the flow of liquid from the reservoir 2 to the nipple fluid outlet 21 is highly restricted, it may be desirable or necessary to deliver fluid from the reservoir 2 to the nipple fluid outlet 21 under a very small amount of pressure, especially in the case where an infant is incapable of creating enough negative pressure around the nipple outlet 21 to withdraw fluid from the nipple 22. It must be remembered, however, that when the flow of liquid to the nipple outlet 21 is highly restricted, it is restricted to prevent the infant from becoming distressed by too much liquid being introduced into the infant's mouth at too fast of a rate. Accordingly, only a very low positive pressure should ever be developed in the reservoir 2, so that the quantity and flow rate of liquid exiting the nipple fluid outlet are low enough to prevent distress for the infant. The pump 31 is powered by a motor 32 and has an air inlet as shown in FIG. 3. A motor speed control 33 and a timer 34 may be operatively associated with the pump 31 to control the quantity and pressure of the air that is pumped through the tube 30 into the reservoir, as desired. As an alternative to the pump 31, a small hand operated bulb type pump 35 may be connected to the tube so that a care giver can manually pressurize the inside of the reservoir 2.

Figure 4:
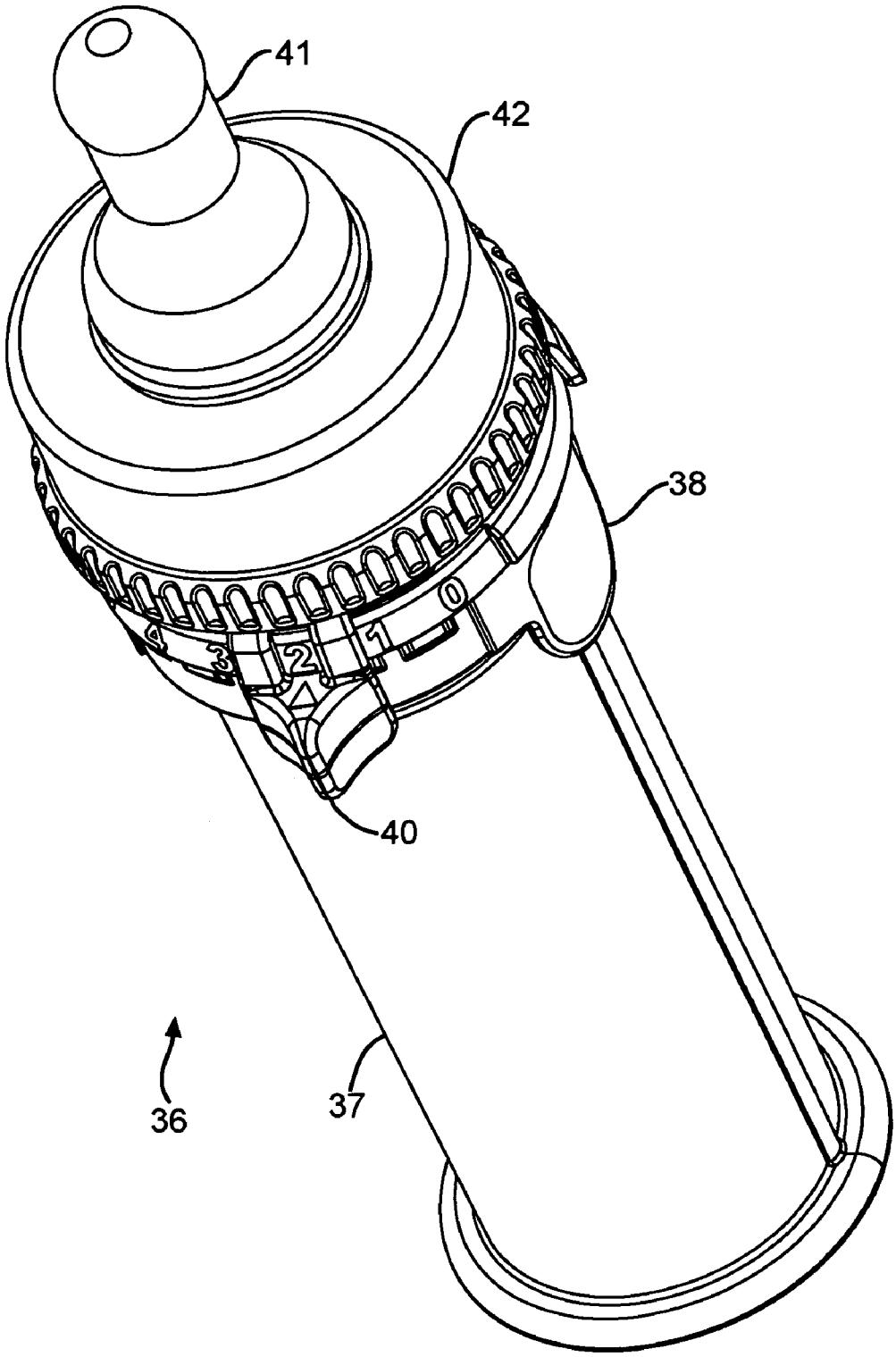
FIG. 4 is a perspective view of another embodiment of a feeding device according to the present invention.
Figure 5:
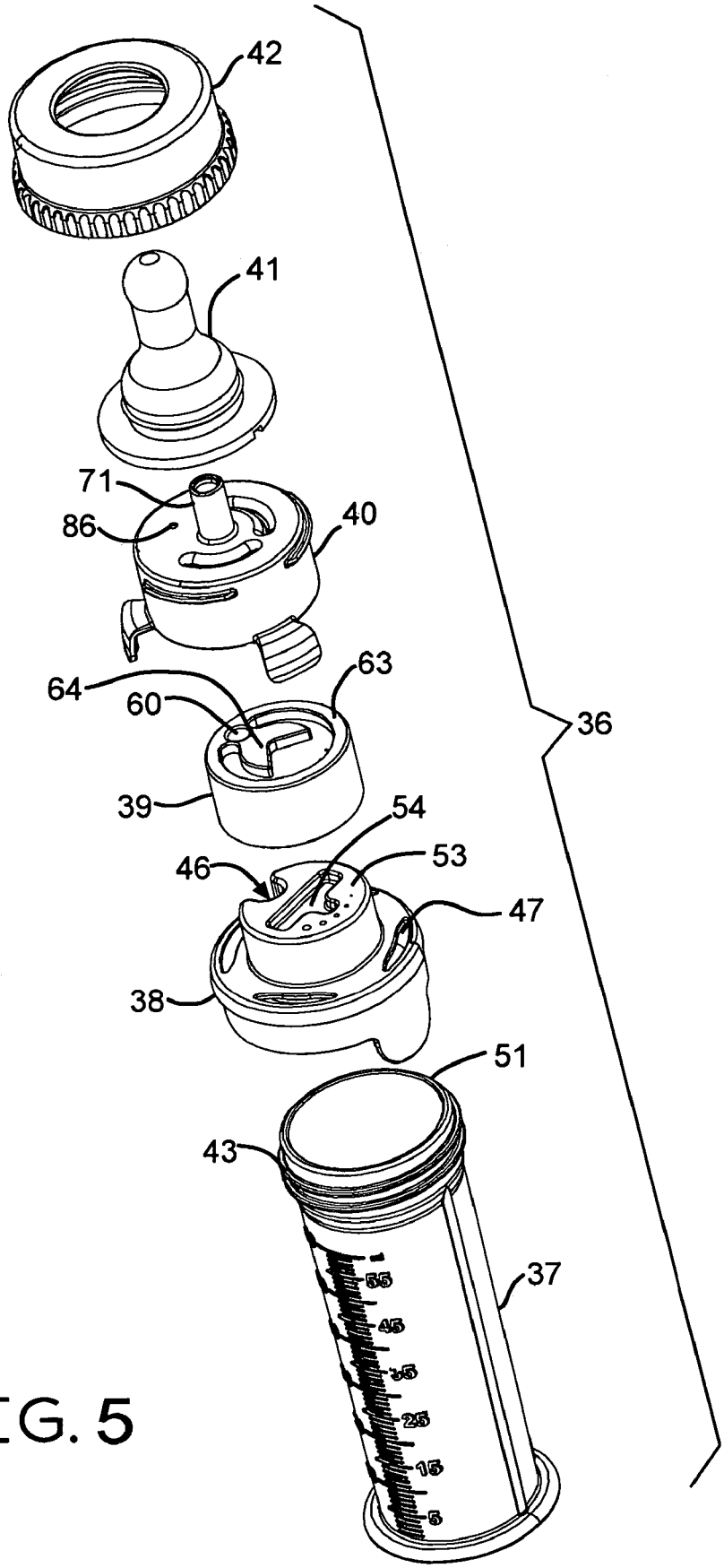
FIG. 5 is an exploded perspective view showing the components of the feeding device of FIG. 4.
Figure 6:
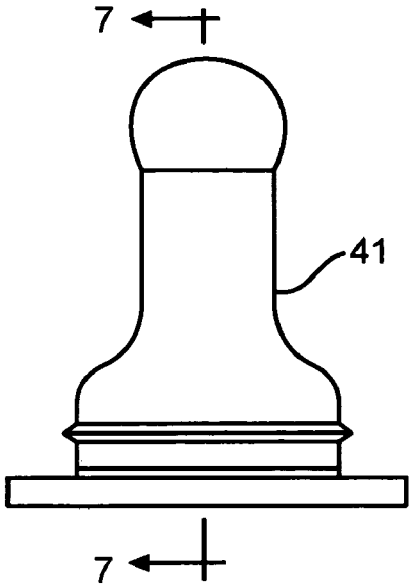
FIG. 6 is a view in elevation showing a nipple which is one of the components of the feeding device of FIG. 4.
Figure 7:
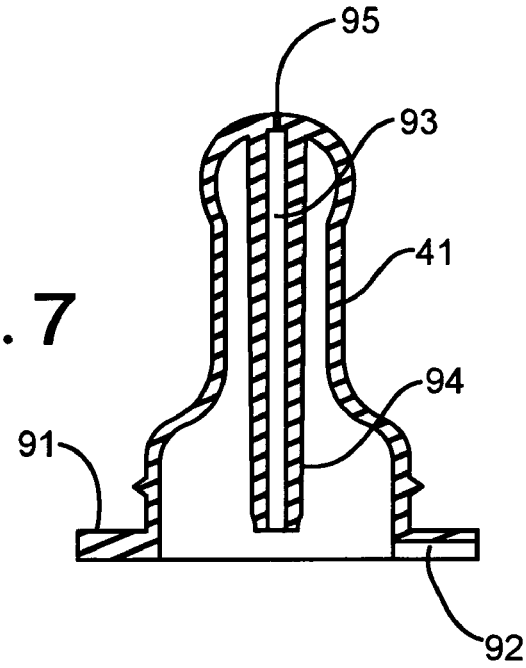
FIG. 7 is a cross-sectional view of the nipple of FIG. 6.
Figure 8:
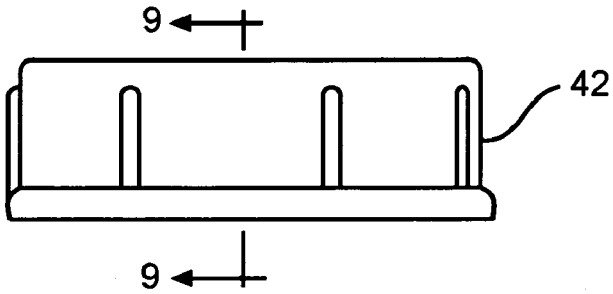
FIG. 8 is a view in elevation showing a cap which is one of the components of the feeding device of FIG. 4.
Figure 9:
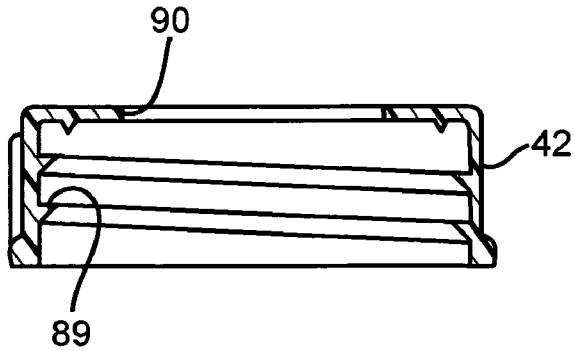
FIG. 9 is a sectional view taken along the line 9-9 of FIG. 8.
Figure 13:
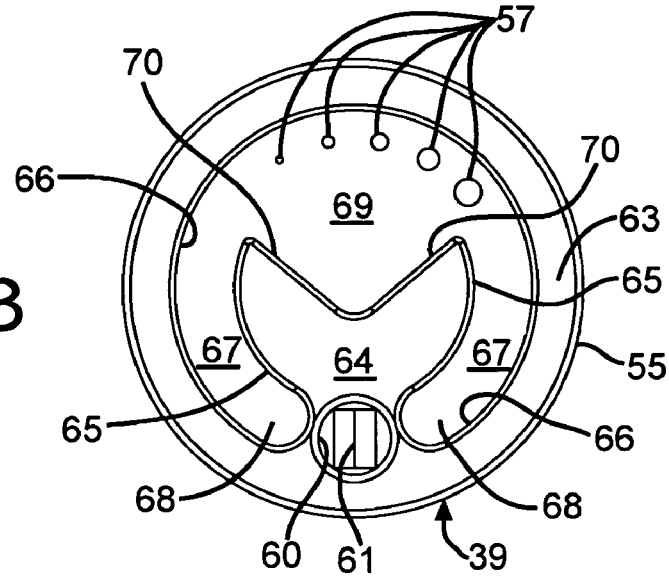
FIG. 13 is a plan view showing the top of a seal that is part of the valve which controls the flow of liquid from the feeding device of FIG. 4.
Figure 14:
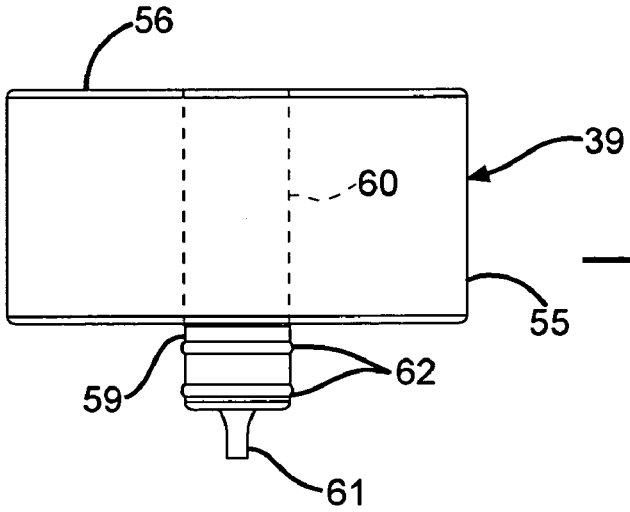
FIG. 14 is a view in elevation of the seal.
Figure 15:
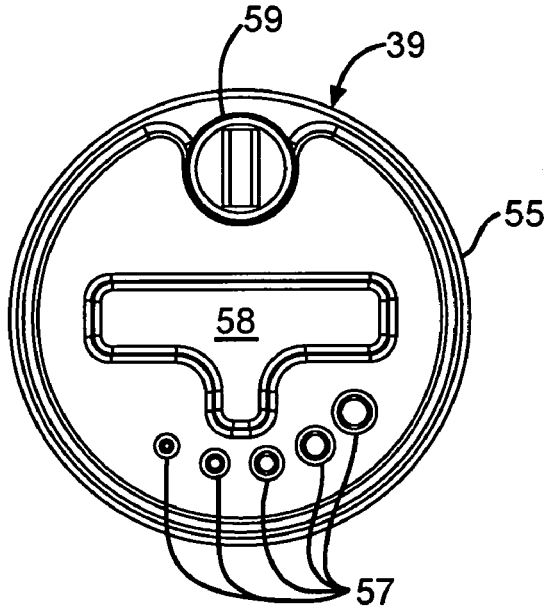
FIG. 15 is a bottom view of the seal.
Figure 16:
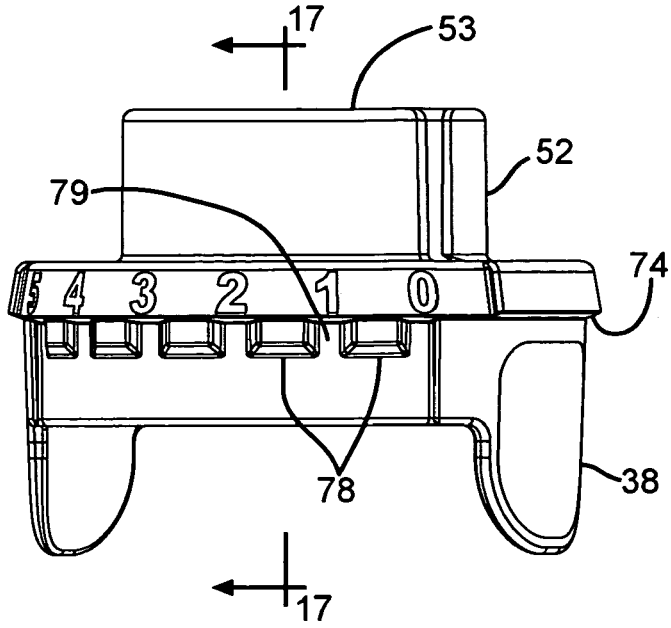
FIG. 16 is a view in elevation of a cap for the reservoir shown in FIGS. 4 and 5.
Figure 17:
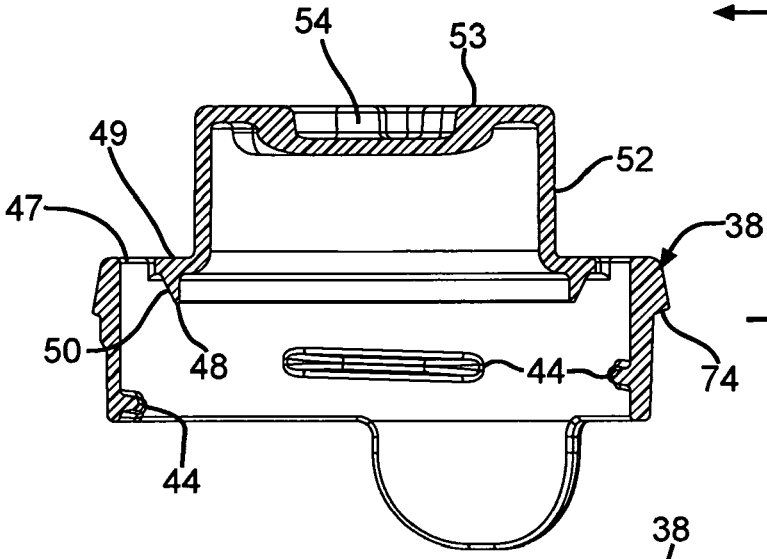
FIG. 17 is a vertical sectional view taken along the line 17-17 of FIG. 16 of the reservoir cap.
Figure 18:
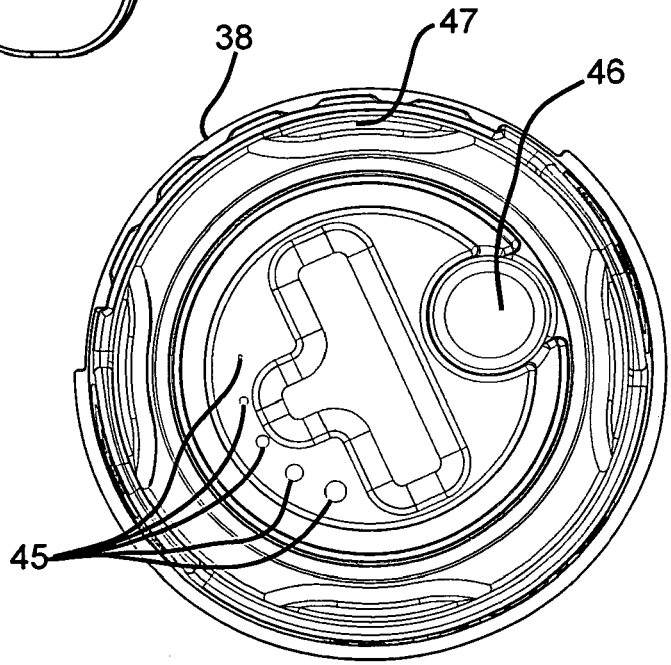
FIG. 18 is a view of the bottom of the reservoir cap.

Referring now to FIGS. 4 and 5, another embodiment of a device according to the invention is indicated generally at 36. The device 36 comprises a reservoir 37, a reservoir cap 38 (shown in more detail in FIGS. 16 through 18), a seal 39 (FIG. 5 and shown in more detail in FIGS. 13 through 15), a selector 40 (shown in more detail in FIGS. 10 through 12), a nipple 41 (shown in more detail in FIGS. 6 and 7) and a nipple ring 42 (shown in more detail in FIGS. 8 and 9). As shown, the reservoir 37 has a capacity of about 60 mis.

The reservoir 37 is provided, adjacent to an open end, with external threads 43 (FIG. 5) which cooperate with internal threads 44 (FIG. 17) on the reservoir cap 38 for securing the cap 38 to the reservoir 37. The cap 38 closes the open end of the reservoir 37 except for five delivery apertures of different sizes, indicated at 45 in FIG. 18, and one relief aperture, indicated at 46, all of which extend through the reservoir cap 38. There are additional apertures, indicated at 47, formed in the cap 38 but, when the cap 38 is secured to the reservoir 37, these apertures 47 are outside of the open end of the reservoir 37 and the reservoir 37 is closed except for the five delivery apertures 45 and the relief aperture 46 formed in the reservoir seal 38. The apertures 47 are present simply because they facilitate the molding of the cap 38. An annular ridge 48 extends downwardly from a shoulder 49 on the cap 38 and includes a sloping face 50 which seals against a wall 51 (FIG. 5) adjacent to the open end of the reservoir 37 when the cap 38 is secured to the reservoir 37. An annular wall 52 extends axially from the shoulder 49 to a top 53 of the cap 38. A T-shaped keyway or depression 54 is formed on the outside of the top 53 of the cap 38.

The seal 39 (FIGS. 13 through 15) has an annular wall 55 which surrounds the annular wall 52 of the cap 38 when the device 36 is assembled. The seal 39 has a top 56 which has five delivery apertures indicated at 57 and these apertures 57 correspond in size and relative position with the delivery apertures 45 in the cap 38. On the inside of the seal 39, there is a raised T-shaped key 58 that fits precisely into the keyway 54 on the outside of the cap 38. The key 58 and the keyway 54 cooperate and serve to align the delivery apertures 57 in the seal 39 with the delivery apertures 45 in the cap 38 and to maintain this alignment while the device 36 is in use. When the cap 38 and the seal 39 are thus aligned, a relief valve assembly 59 on the seal 39 aligns with and extends through the relief aperture 46 in the cap 38. The valve assembly 59 includes a cylinder 60 that extends from the top 56 of the seal 39 down to a flapper valve/duck-bill valve 61 that is in fluid communication with the inside of the reservoir 37. Sealing rings 62 on the cylinder 60 of the relief valve assembly 59 effect a seal with a portion of the cap 38 that defines the relief valve aperture 46. The duck-bill/flapper valve 61 is extremely sensitive and it is operable to open when ambient pressure exceeds the pressure within the reservoir 37 by a very slight amount so that the pressure inside the reservoir 37 remains substantially equal to the ambient pressure. This prevents a vacuum condition from being created inside the reservoir 37 that would otherwise interfere with the withdrawal of fluid from the reservoir 37 through the nipple 41. The valve 61 is a one way valve and it closes to prevent fluid inside the reservoir 37 from leaving the reservoir through the valve 61.

A raised ring 63 is formed on the top 56 of the seal 39 and the raised ring 63 is at the same height as a raised central portion 64 having outer walls 65 that are spaced from inner walls 66 of the raised ring 63. Two recessed channel floors 67 extend between the outer walls 65 and the inner walls 66 and together, they define a pair of annular channels 68. A similarly recessed delivery conduit chamber floor 69 extends between the two recessed channel floors 67 and the delivery apertures 57 extend through the recessed delivery conduit chamber floor 69 of the seal 39. The delivery conduit chamber floor 69 extends from the inner wall 66 of the raised ring 63 to a pair of delivery conduit chamber walls 70 on the raised central portion 64.

Figure 10:
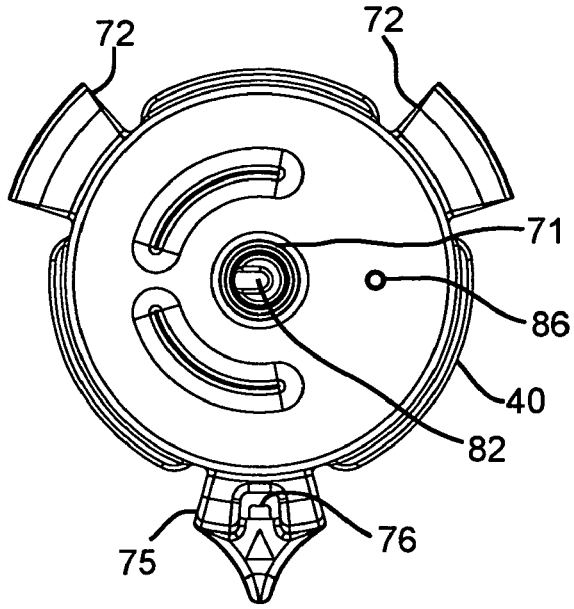
FIG. 10 is a plan view showing the top a selector that is part of a valve which controls the flow of liquid from the feeding device of FIG. 4.
Figure 11:
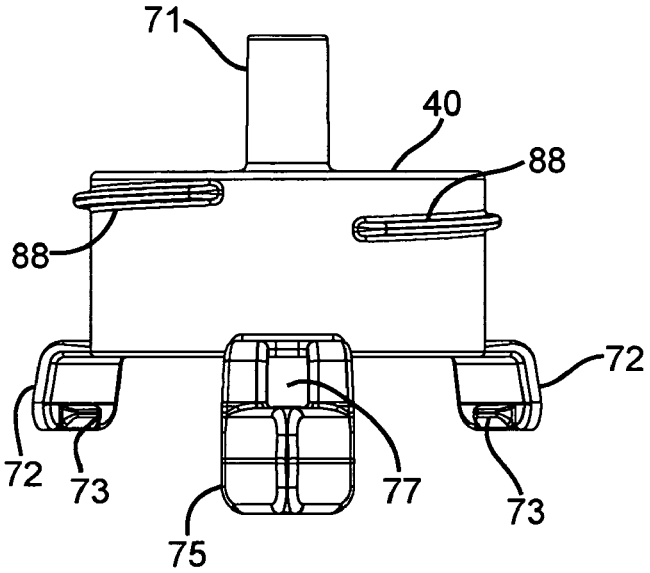
FIG. 11 is a view in elevation of the selector.
Figure 12:
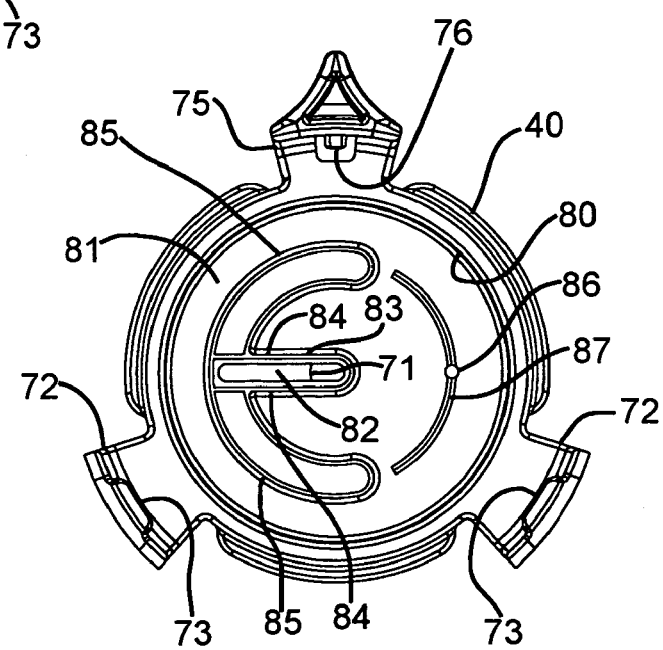
FIG. 12 is a plan view showing the bottom of the selector.

Referring now to FIGS. 10 through 12, the selector 40 cooperates with the seal 39 to provide communication between one or none of the delivery apertures 57 in the seal and the nipple 41 through an axially extending outlet tube 71 on the selector 40. The seal 39 is made of a somewhat resilient material (a soft silicone is a preferred material for the seal 39) that sealingly engages portions of the selector 40, as described below. The selector 40 also cooperates with the relief valve assembly 59 to admit relief air through the valve assembly 59 and into the reservoir 37, as required.

The selector 40 fits over the seal 39 and is releasably secured to the reservoir cap 38. Two connector tabs 72 extend from an inner edge of the selector 40 towards the reservoir cap 38. Each tab 72 has a shoulder 73 with a surface that engages a shoulder 74 (FIGS. 16 and 17) that extends around the periphery of the reservoir cap 38. A third tab 75 (FIGS. 10 through 12) extends from the inner edge of the selector 40 towards the reservoir cap 38 and it includes a shoulder 76 that includes a surface that engages the cap shoulder 74. The tabs 72 and 75 are slightly flexible so that they can flex radially outwardly when the selector 40 is pressed down onto the reservoir cap 38 allowing the shoulders 73 and 76 to clear the shoulder 74. When the shoulders 73 and 76 move past the shoulder 74, the tabs 72 and 75 flex back, radially inwardly, and the selector 40 is held fast to the reservoir cap 38 with the seal 39 held captive between the two parts. The selector 40 can rotate, to a limited degree, relative to the seal 39 and the reservoir cap 38, while the seal 39 and the reservoir cap 38 are prevented from rotating relative to each other by the keyway 54 and the key 58. The tab 75 defines a window 77 (FIG. 11) through which one can see a selected one of the numbers that are provided on the outside of the reservoir cap 38 ("0", "1", "2", "3", "4", "5" and "6"; see FIGS. 4 and 16). The tab 75 thus serves as an indicator to a caregiver as to what relative flow rate is associated with a specific rotational position of the selector 40.

Ramped shoulders 78 are provided on the outside of the reservoir cap to define detent recesses 79 between them. When the selector 40 is rotated or moved to a predetermined rotational position associated with a given flow rate, the shoulder 76 on the third tab 75 is received in one of the detent recesses 79 and when the selector is moved from that position, one of the ramped shoulders 78 will act on the shoulder 76 causing it to flex out and remain out until the selector 40 is rotated to the next adjacent position corresponding with a different flow rate, where the shoulder 76 will enter the next detent recess 79, thereby providing a caregiver with a tactile indication that the selector 40 is or is not in a position where a particular flow rate is selected. The numbers or other indicators on the cap 38 provide a visual indication of that a particular flow rate has been selected.

The selector 40 includes means for channeling fluid from one of the delivery apertures 57 in the seal 39 through outlet tube 71, means for blocking the flow of fluid through the other ones of the delivery apertures 57 and means for providing relief air to the relief valve assembly 59.

Referring now to FIG. 12, we see the inside portion of the selector 40 that 20 comes down on and engages portions of the top 56 of the seal 39. A side wall 80 surrounds a recessed ring 81 that is sized and is recessed just enough to receive the raised ring 63 on the top 56 of the seal 39. A delivery conduit 82 is defined by a raised oval shaped ring 83, which is pressed into a sliding and sealing engagement with the delivery conduit chamber floor 69 of the seal 39 when the parts are assembled. The conduit 82 is operable to provide a fluid connection between one of the delivery apertures 57 in the seal 39 or none of the delivery apertures 57, depending on the rotational position of the selector 40 relative to the seal 39. The raised ring 83 has side walls 84 that cooperate with the delivery conduit chamber walls 70 to limit the extent to which the selector 40 can be rotated relative to the seal 39. One of the side walls 84 abuts one of the delivery conduit chamber walls 70 of the seal 39 when the selector 40 is rotated in a clockwise direction to the full extent, thereby providing fluid communication through the delivery conduit 82 and between the largest one of the delivery apertures 57 in the seal 39 and the outlet tube 71. The other one of the side walls 84 abuts the other one of the delivery conduit chamber walls 70 of the seal 39 when the selector 40 is rotated in a counterclockwise direction to the full extent, thereby providing fluid communication through the delivery conduit 82 and between the outlet tube and a closed portion of the delivery conduit chamber floor 69. In other words, when the selector 40 is rotated in a counterclockwise position until it can't be rotated anymore, there is no flow and no fluid communication between the fluid outlet tube 71 of the selector 40 and any one of the delivery apertures 57. In still other words, a valve comprised of the reservoir cap 38, the seal 39 and the selector 40 is closed. As the selector 40 is rotated clockwise from the closed position, the delivery conduit 82 will reach a position where it provides fluid communication between the smallest delivery aperture and the outlet tube 71 of the selector 40. Further rotation of the selector 40 in a clockwise direction will successively position the delivery conduit 82 to provide fluid communication between the fluid outlet tube 71 and the next larger delivery aperture, then the next larger delivery aperture, then the next larger delivery aperture and, finally, the largest delivery aperture.

Next to the delivery conduit 82, there are two sealing regions extending circumferentially from the delivery conduit 82 and the sealing regions are defined by raised ridges 85 which slidingly and sealingly engage portions of the delivery conduit chamber floor 69 and portions of the recessed floors 67 of the seal 39. This sealing engagement between the ridges 85 and the floors 67 and 69 of the seal 39 serves to prevent fluid communication between all of the delivery apertures 57 that are not in fluid communication with the outlet tube 71 through the delivery conduit 82.

A relief air aperture, indicated at 86, permits relief air to enter the space between the seal 39 and the selector 40 and to flow in a recessed channel 87. In all possible rotational positions of the selector 40 relative to the seal 39, the channel 87 is in fluid communication with the inside of the relief valve cylinder, thereby permitting relief air to enter the reservoir 37 through the relief valve assembly 59.

On the outside of the selector 40, there are external thread portions 88. These correspond in size and pitch to the external threads 43 on the reservoir 38 but the thread portions 88 are discontinuous. The nipple ring is provided with internal threads 89 adapted to engage the external thread portions 88. The discontinuities in the thread portions 88 permit air to move from outside of the nipple ring 42 into the space between the nipple ring 42 and the selector 40. An opening in the nipple ring is defined by an annular flange 90 that is adapted to engage a nipple flange 91 when the nipple 41 is pushed mostly through the nipple ring aperture defined by the flange 90. When the ring 42 is secured to the selector 40, the flange 90 presses the nipple flange 91 against an upper surface of the selector 40. This is not an air tight seal, however, as there is a vent, indicated at 92, in the nipple flange 91 to provide fluid communication for relief air to move into communication with the relief valve aperture 86 in the selector 40.

Figure 19:
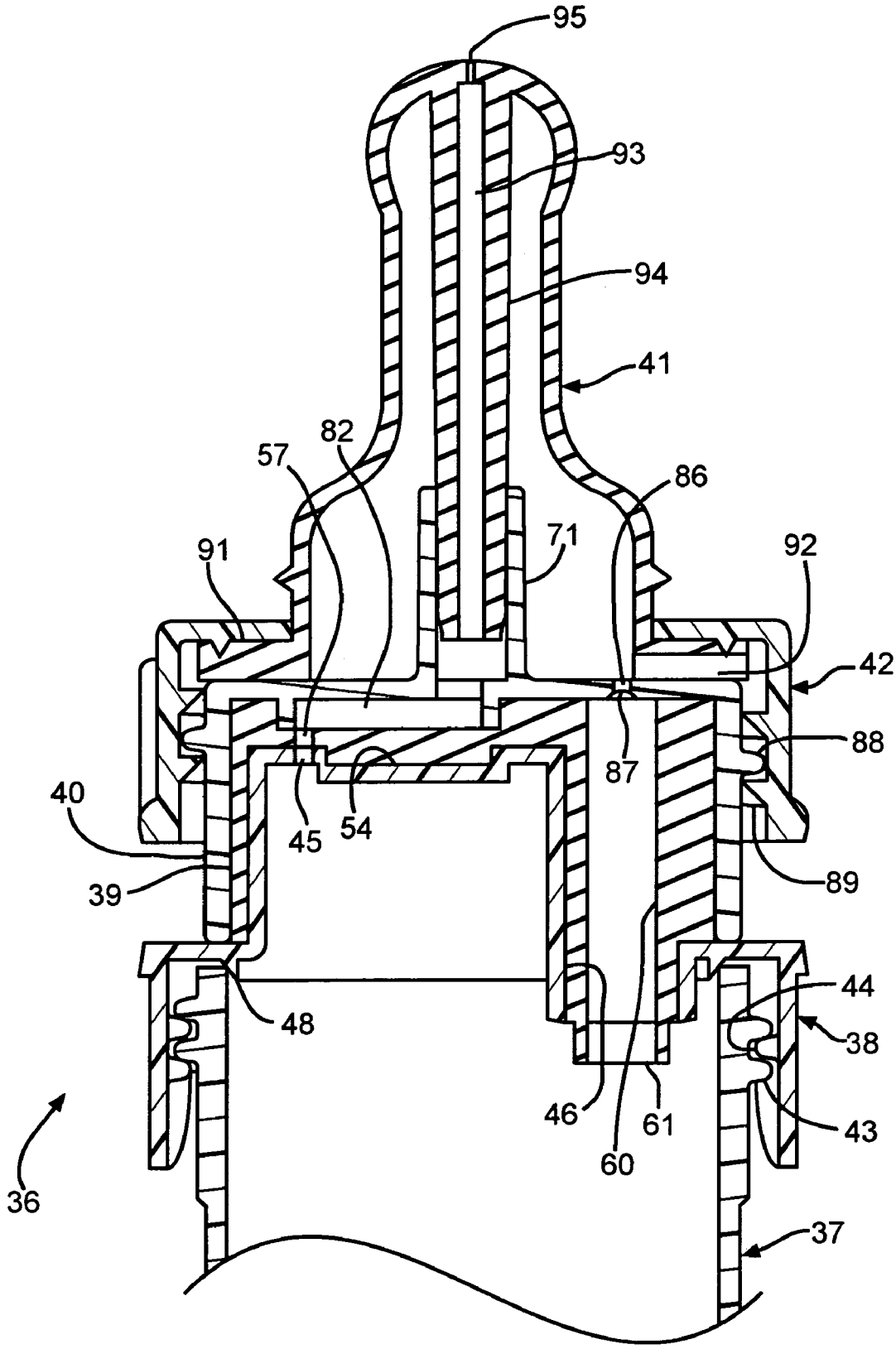
FIG. 19 is a vertical sectional view showing details of the structure of and fluid flow through the feeding device of FIG. 4.

A nipple fluid conduit 93 is defined by a nipple fluid tube 94 which is flexible and has one end that is integrally connected to the nipple 41, adjacent to a nipple fluid outlet 95 and another end that is adapted to be inserted into the fluid outlet tube 71 of the selector 40 in fluid tight relationship, as shown in FIG. 19.

Referring now to FIG. 19, the delivery of fluid from inside of the reservoir to and through the nipple outlet aperture 95, when the selector 40 is set to a position other than a zero flow position and negative pressure is applied around the nipple 41, will now be described. Fluid is put into the reservoir 37 and the cap 38, the seal 39, the selector 40, the nipple 41 and the ring 42 are assembled with the reservoir 37 as shown in FIG. 19. The selector 40 has been set to a position that is not a zero flow position, where the delivery conduit is in communication with a given one of the seal apertures 57 which, in turn, is in communication with a given, corresponding aperture 45 in the cap 38. When the device 36 is tilted so that gravity causes some fluid to be in contact with the given aperture 45 in the cap 38 and negative pressure or sucking at the nipple outlet is initiated, fluid will be drawn from inside of the reservoir 37, through the aperture 45, the aperture 57, the delivery conduit 82, the outlet tube 71 and the nipple fluid conduit 93, and out of the nipple outlet aperture 95. As fluid is withdrawn from the reservoir 37, a negative pressure will begin to develop inside of it and this will initiate a flow of relief air from outside of the reservoir 37 to the inside of it. Specifically, a negative pressure inside of the reservoir 37 will cause air from outside of the reservoir 37 to move through the nipple vent 92, into the space outside of the outlet tube 71 and the nipple fluid tube 94, through the relief air aperture in the selector 40, through the recessed channel 87, through the relief valve cylinder 60 and through the valve 61 into the reservoir 37.

In sum, the present device is useful to promote and facilitate the transition from non-nutritive sucking on the nipple of the device with the valve selector set to zero flow, to nutritive sucking sufficient to sustain the infant. The invention is especially useful for premature infants that have not learned to take nutrition orally as well as for other medically fragile infants. The feeding device and method are used first to acclimate an infant to a particular nipple and, thereafter, to administer liquid nutrition to the infant, initially, at a very low flow rate so that an infant who is capable of sucking fluid at a substantial flow rate from a nipple but is incapable of coordinating its suck/swallow/breathe pattern to accommodate that flow rate, can take fluid orally without becoming distressed. The present invention permits the oral administration liquids, formula and/or breast milk in a non-threatening and barely detectable manner, initially, with a gradual transition to higher flow rates thereby taking an infant gradually from a functional non-nutritive suck on a nipple that does not deliver fluid to efficient, nutritive oral feedings from a bottle capable of sustaining the infant. The method of controlling the flow rate and being able to adjust that rate without interrupting the suck, swallow, breathe, burst and pause process is very important. There is a tremendous transition that occurs physiologically between non-nutritive and nutritive sucking. This transition can be extremely overwhelming to the neonate with an immature respiratory system when required to coordinate the suck/swallow/breathe cycle essential for nutritive feeding.

The above detailed description of the present invention is given for explanatory purposes. It will be apparent to those skilled in the art that numerous changes and modifications can be made without departing from the spirit and scope of the invention. Accordingly, the whole of the foregoing description is to be construed in an illustrative and not a limitative sense, the scope of the invention being defined solely by the appended claims.

We claim:

1. A feeding device for infants, said feeding device comprising a fluid reservoir, a nipple having at least one fluid outlet, a conduit for conveying fluid from said reservoir to said nipple fluid outlet, and a valve associated with said conduit, said valve including a selector that is manually settable to a first position in which said valve is operable to essentially prevent fluid from being conveyed through said conduit, said selector being manually settable to a second, open position in which said valve is operable to permit the flow of fluid from said reservoir at a given rate and said selector being manually settable to a third, intermediate position in which said valve is operable to restrict the flow of fluid from said reservoir to a rate that is less than the given rate, wherein compression of said nipple does not cause expression of any significant quantity of fluid from said outlet.

2. The device claimed in claim 1 wherein said nipple is a straight nipple.

3. The device claimed in claim 1 wherein said reservoir has a fluid capacity of at least 4 ounces.

4. A feeding device for infants, said feeding device comprising a fluid reservoir, a nipple having at least one fluid outlet, a conduit for conveying fluid from said reservoir to said nipple fluid outlet, and a valve associated with said conduit, said valve including a selector that is manually settable to a first position in which said valve is operable to essentially prevent fluid from being conveyed through said conduit, said selector being manually settable to a second, open position in which said valve is operable to permit the flow of fluid from said reservoir at a given rate and said selector being manually settable to a third, intermediate position in which said valve is operable to restrict the flow of fluid from said reservoir to a rate that is less than the given rate, wherein said nipple does not expel fluid when it is compressed.

5. The device claimed in claim 4 wherein said nipple is a straight nipple.

6. The device claimed in claim 4 wherein said reservoir has a fluid capacity of at least 4 ounces.

7. A feeding device for infants, said feeding device comprising a fluid reservoir, a nipple having at least one fluid outlet, a conduit for conveying fluid from said reservoir to said nipple fluid outlet, and a valve associated with said conduit, said valve including a selector that is manually settable to a first position in which said valve is operable to essentially prevent fluid from being conveyed through said conduit, said selector being manually settable to a second, open position in which said valve is operable to permit the flow of fluid from said reservoir at a given rate and said selector being manually settable to a third, intermediate position in which said valve is operable to restrict the flow of fluid from said reservoir to a rate that is less than the given rate, wherein said conduit includes a nipple fluid tube and wherein said nipple does not expel fluid when it is compressed.

8. The device claimed in claim 7 wherein said nipple is a straight nipple.

9. The device claimed in claim 7 wherein said reservoir has a fluid capacity of at least 4 ounces.

* * * * *